US008403053B2

(12) United States Patent
Judge

(10) Patent No.: US 8,403,053 B2
(45) Date of Patent: Mar. 26, 2013

(54) CIRCUIT FUNCTIONAL TEST SYSTEM AND METHOD

(75) Inventor: Robert Arnold Judge, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 12/971,179

(22) Filed: Dec. 17, 2010

(65) Prior Publication Data

US 2012/0152555 A1 Jun. 21, 2012

(51) Int. Cl.
*E21B 34/04* (2006.01)
*E21B 33/06* (2006.01)

(52) U.S. Cl. ..... 166/336; 166/339; 166/344; 166/363; 166/250.01; 166/373; 251/1.1

(58) Field of Classification Search ..... 166/339, 166/336, 338, 344, 351, 363, 368, 250.01, 166/373–375, 381, 386, 316; 251/1.1–1.3
See application file for complete search history.

(56) References Cited

U.S. PATENT DOCUMENTS 3,207,221 A * 9/1965 Cochran et al. ..... 166/85.4
4,413,642 A * 11/1983 Smith et al. ..... 137/14
4,923,008 A * 5/1990 Wachowicz et al. ..... 166/373
6,032,742 A * 3/2000 Tomlin et al. ..... 166/345
6,422,315 B1 * 7/2002 Dean ..... 166/339
6,484,806 B2 * 11/2002 Childers et al. ..... 166/351
6,502,640 B2 * 1/2003 Rayssiguier et al. ..... 166/375
6,622,799 B2 * 9/2003 Dean ..... 166/381
6,938,695 B2 * 9/2005 Williams ..... 166/341
7,216,714 B2 * 5/2007 Reynolds ..... 166/338
7,216,715 B2 * 5/2007 Reynolds ..... 166/339
7,222,674 B2 * 5/2007 Reynolds ..... 166/341
7,690,433 B2 * 4/2010 Reynolds ..... 166/338
7,757,772 B2 * 7/2010 Donohue et al. ..... 166/344
7,921,917 B2 * 4/2011 Kotrla et al. ..... 166/339
2010/0084588 A1 * 4/2010 Curtiss et al. ..... 251/57
2011/0114329 A1 * 5/2011 Emecheta et al. ..... 166/350

* cited by examiner

*Primary Examiner* — Matthew Buck

(74) *Attorney, Agent, or Firm* — Bracewell & Giuliani LLP

(57) ABSTRACT

Method and deadman test circuit for testing a functionality of a shearing blowout preventer. The circuit includes a solenoid valve configured to be electrically controlled and to receive a fluid under a first pressure; a sub plate mounted valve configured to be hydraulically controlled by the solenoid valve and to receive the fluid under a second pressure; and a selector valve fluidly connecting an output of the sub plate mounted valve to a shearing blowout preventer and to a device. The selector valve is configured to be operated by an operator.

17 Claims, 9 Drawing Sheets

CIRCUIT FUNCTIONAL TEST SYSTEM AND METHOD

BACKGROUND

1. Technical Field

Embodiments of the subject matter disclosed herein generally relate to methods and systems and, more particularly, to mechanisms and techniques for testing an existing circuit that activates a hydraulic device.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for drilling for fossil fuel from offshore fields use a system 10 as shown in FIG. 1. More specifically, the system 10 includes a vessel 12 (e.g., oil rig) having a reel 14 that supplies power/communication cords 16 to a controller 18. The controller 18 is disposed undersea, close to or on the seabed 20. In this respect, it is noted that the elements shown in FIG. 1 are not drawn to scale and no dimensions should be inferred from FIG. 1 or other figures.

FIG. 1 also shows a wellhead 22 of the subsea well and a drill string 24 that enters the subsea well. At the end of the drill string 24 there is a drill bit (not shown). Various mechanisms, also not shown, are employed to rotate the drill string 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure inside the well exceeds the pressure applied to it by the column of drilling fluid. This event is unforeseeable and if no measures are taken to prevent it, the well and/or the associated equipment may be damaged. Although the above discussion was directed to subsea oil exploration, the same is true for ground oil exploration.

Thus, a blowout preventer (BOP) might be installed on top of the well to seal the well in case that one of the above mentioned events is threatening the integrity of the well. The BOP is conventionally implemented as a valve to prevent the release of pressure either in the annular space between the casing and the drill pipe or in the open hole (i.e., hole with no drill pipe) during drilling or completion operations. Recently, a plurality of BOPs may be installed on top of the well for various reasons. For example, a first BOP (shear BOP) may be configured to shear the tools that are inside the borehole, a second BOP (blind BOP) may be configured to seal the borehole without shearing the tools inside, a third BOP (annular BOP) may be configured to close an elastomer around the tools, etc. FIG. 1 shows two BOPs 26 or 28 that are controlled by the controller 18. It is noted that some in the art refer to a ram BOP and this element may have plural number of cavities, each cavity having a different device, e.g., the annular BOP, the blind BOP, etc.

A traditional BOP may be one to five meters high and may weight tens of thousands of kilograms. An example of a BOP 26 is shown in FIG. 2. The BOP 26 shown in FIG. 2 has, among other things, two ram blocks 30 that are supported by respective piston rods 32 and a corresponding locking mechanism 33, which is configured to lock the rods 32 at desired positions. The two ram blocks 30 are configured to move inside a first chamber 34 (horizontal bore) along a direction parallel to a longitudinal axis X of the piston rods 32. The ram blocks 30 may be configured to severe the drill string 24 or other tools that cross a second chamber 36 (vertical wellbore) of the BOP 26. First and second chambers are substantially perpendicular to each other. However, after cutting the drill string 24 for a number of times (if a shear ram block is installed), the ram blocks 30 and/or their respective cutting edges need to be verified and sometimes reworked. For this reason, the BOP 26 of FIG. 2 is provided with a removable bonnet 38, for each ram block 30, which can be opened for providing access to the ram blocks. FIG. 2 shows the bonnet 38 having a hinge 40 that rotatably opens the bonnet 38.

As the BOPs are configured to seal a well in case of an accident, their integrity is regulated by government norms. One such norm requires that a shear BOP is tested every 14 days. Testing a shear BOP is not a straightforward process for the following reasons. To test the shear BOP, the entire rig operations need to be suspended to retrieve the drill string to a position above the shear ram cavity so that the drill string is not cut during the test. Retrieving the drill string to this position can be a time consuming effort, and an alternative test method that ensures the shearing function can be accomplished without actually shearing pipe or moving the shear ram operators is desirable.

Accordingly, it would be desirable to provide systems and methods that avoid the afore-described problems and drawbacks.

SUMMARY

According to one exemplary embodiment, there is a deadman test circuit for testing a functionality of a shearing circuit on a blowout preventer. The deadman test circuit includes a solenoid valve configured to be electrically controlled and to receive a fluid under a first pressure; a sub plate mounted valve configured to be hydraulically controlled by the solenoid valve and to receive the fluid under a second pressure; and a selector valve fluidly connecting an output of the sub plate mounted valve to a shearing blowout preventer (BOP) and to a device. The selector valve is configured to be operated by an operator.

According to another exemplary embodiment, there is a blowout preventer assembly for sealing a well head. The assembly includes a lower marine riser package configured to be provided at an end of a riser and to be lowered undersea; and a MUX pod attached to the lower marine riser package. The MUX pod is configured to receive a fluid under a first pressure and includes a solenoid valve configured to be electrically controlled and to receive a fluid under a second pressure, and a sub plate mounted valve configured to be hydraulically controlled by the solenoid valve and to receive the fluid under the first pressure. The assembly also includes a selector valve fluidly connecting an output of the sub plate mounted valve to a shearing BOP and to a device. The selector valve is configured to be operated by an operator.

According to still another exemplary embodiment, there is a blowout preventer stack that includes plural blowout preventers including at least a shearing blowout preventer; a device configured to be actuated by a fluid under pressure; and a selector valve fluidly connected to the shearing BOP and to the device. The selector valve is configured to be operated by an operator to communicate either with the shearing BOP or with the device.

According to still another exemplary embodiment, there is a method for performing a deadman test on a shearing blowout preventer. The method includes a step of activating a selector valve to disconnect a shearing blowout preventer from a supply of a fluid under pressure such that the shearing blowout preventer is inoperative; a step of providing the fluid under pressure to a pressure activated device; a step of generating information with regard to a pressure of the fluid under pressure inside the pressure activated device; and a step of transmitting the information to a storage device or an operator.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a shear BOP system. However, the embodiments to be discussed next are not limited to these systems, but may be applied to other systems that need to be tested.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a deadman circuit that controls the closing of a shearing BOP is modified to include a selector valve or a similar device to divert a hydraulic fluid from the shearing BOP when so desired by an operator of the BOP. Variants of the deadman circuit are now discussed with regard to the figures.

Figure 1:
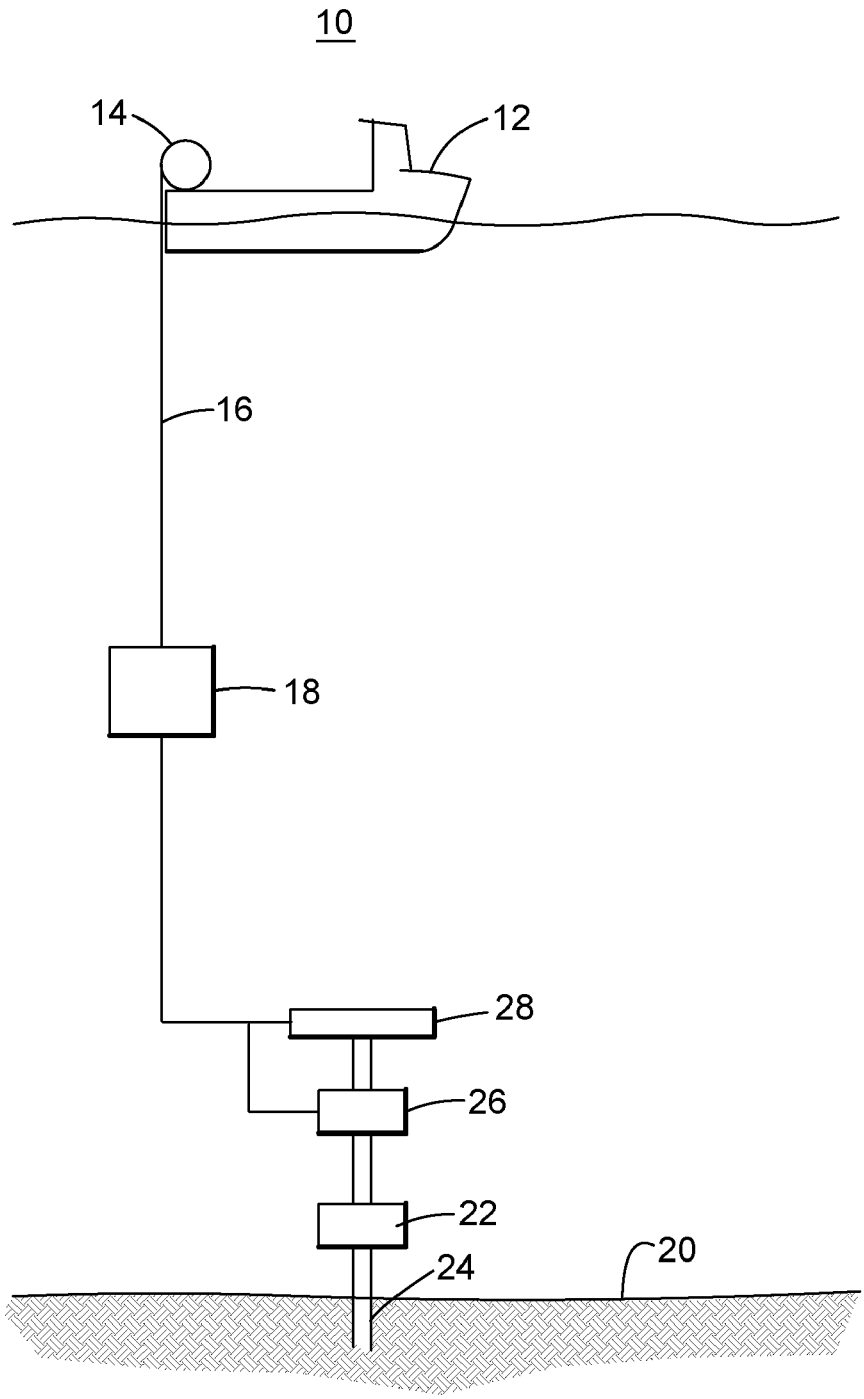
Figure 1 Background Art
FIG. 1 is a schematic diagram of a conventional offshore rig.
Figure 2:
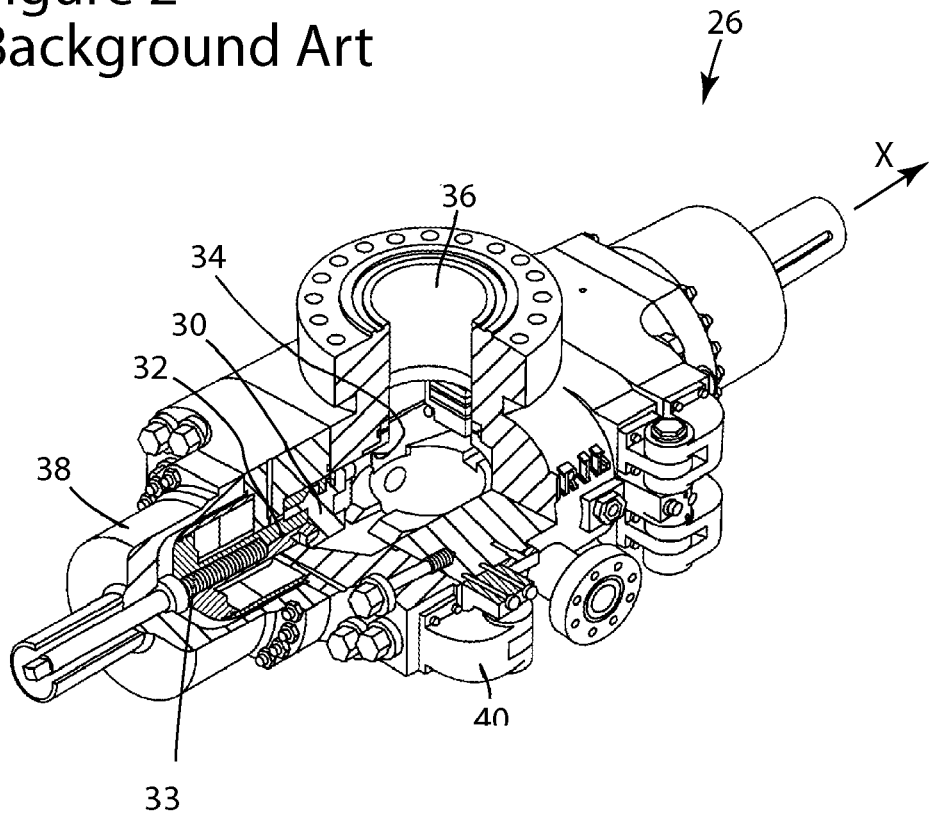
Figure 2 Background Art
FIG. 2 is a schematic diagram of a blowout preventer.
Figure 3:
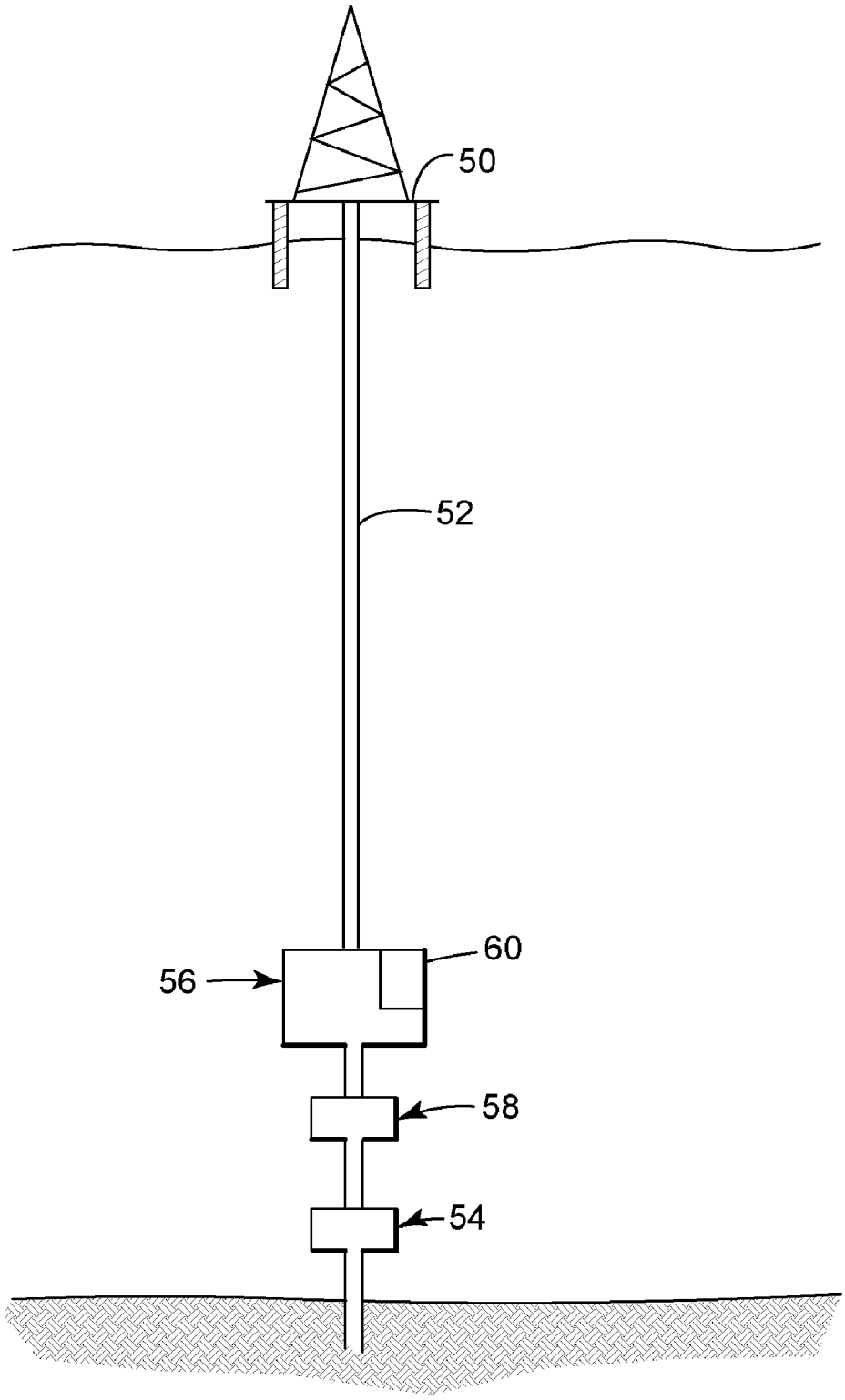
FIG. 3 is a schematic diagram of a lower marine riser package connected to a blowout preventer stack.

For a better understanding of the various elements to be discussed next, a structure of an undersea blowout preventer assembly is now discussed. Such an assembly, as illustrated in FIG. 3, includes a rig 50 connected via a riser 52 to a wellhead 54. The riser 52 ends with a Lower Marine Riser Package (LMRP) 56. The LMRP 56 is removably connected to a lower BOP stack 58 that may include plural ram BOP cavities, one of which is a shearing BOP cavity. For simplicity, the shearing BOP cavity is referred to from now on as shearing BOP. The ram BOPs are controlled by a MUX pod 60, traditionally located on the LMRP 56. However, the MUX pod 60 may be located on the lower BOP stack 58 and annular BOPs may be located on the LMRP 56. Also, the ram BOPs could be controlled by a direct acting hydraulic control system, where individual functions are controlled from the surface via dedicated hydraulic pilot lines in a hydraulic umbilical bundle.

Figure 4:
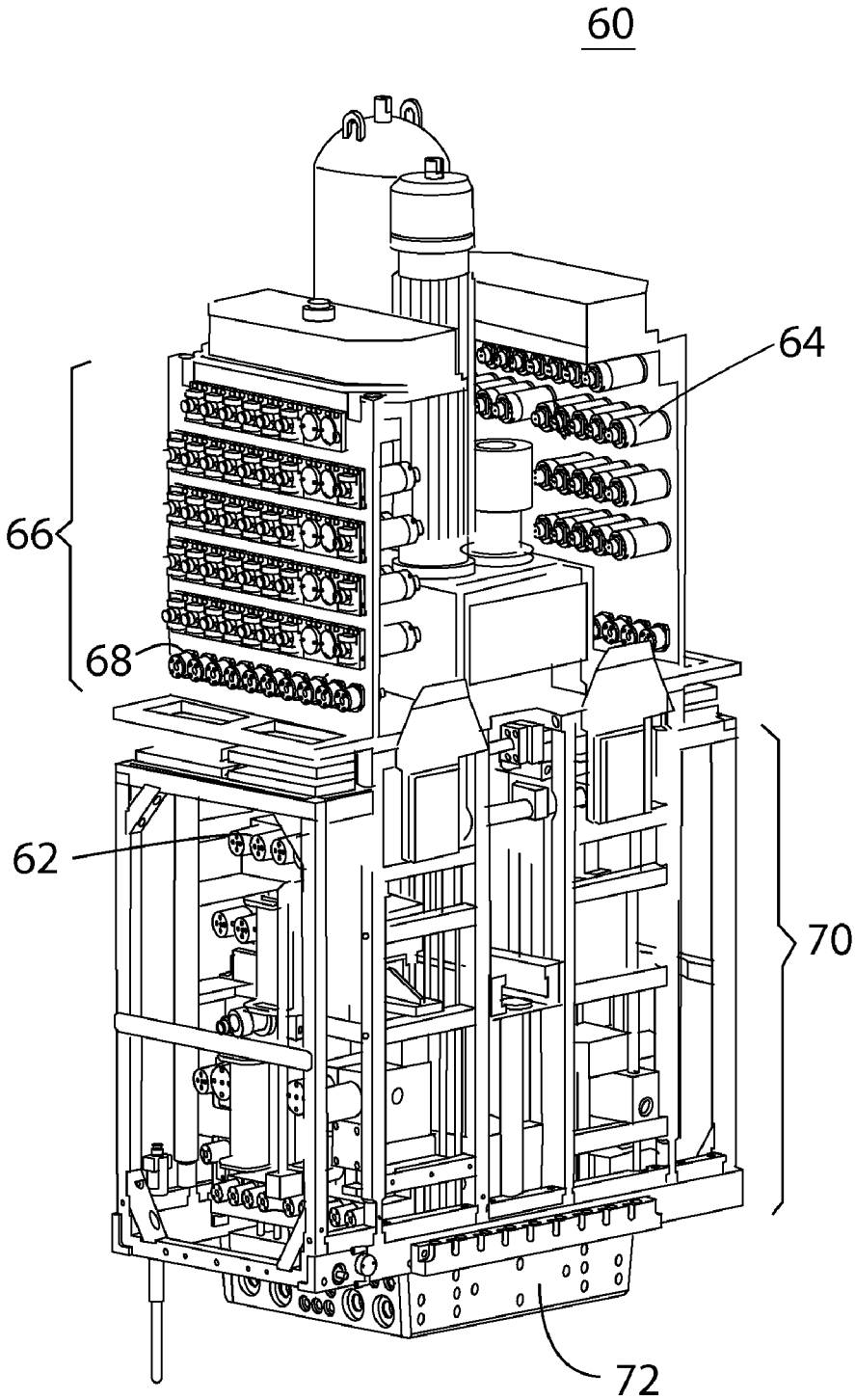
FIG. 4 is a schematic diagram of a MUX pod.

FIG. 4 illustrates the MUX pod 60 as having between 50 and 100 different functions for controlling the lower BOP stack 58 and/or the LMRP 56. The MUX pod 60 is fixedly attached to a frame (not shown) of the LMRP 56 (or the lower BOP stack 58) and may include hydraulically activated valves 62 (called in the art sub plate mounted (SPM) valves) and solenoid valves 64 that are fluidly connected to the hydraulically activated valves 62. The solenoid valves 64 are provided in an electronic section 66 and are designed to be actuated by an electrical signal sent from an electronic control board (not shown). Each solenoid valve 64 is configured to activate a corresponding hydraulically activated valve 62. The MUX pod 60 may include pressure sensors 68 also mounted in the electronic section 66. The hydraulically activated valves 62 are provided in a hydraulic section 70 and are fixedly attached to the MUX pod 60.

In subsea blowout preventer installations, multiplex ("MUX") cables (electrical) and/or lines (direct acting hydraulic) transport control signals (via the MUX pod 60 and a pod wedge 72) to the LMRP 56 and the lower BOP stack 58 devices so specified tasks may be controlled from the surface. Once the control signals are received, subsea control valves are activated and (in most cases) high-pressure hydraulic lines are directed to perform the specified tasks. Thus, a multiplexed electrical or hydraulic signal may operate a plurality of "low-pressure" valves to actuate larger valves to communicate the high-pressure hydraulic lines with the various operating devices of the wellhead stack. For simplicity, a high-pressure fluid transmitted to such a device is called a hydraulic signal, similar to an electronic signal that controls a solenoid valve.

Figure 5:
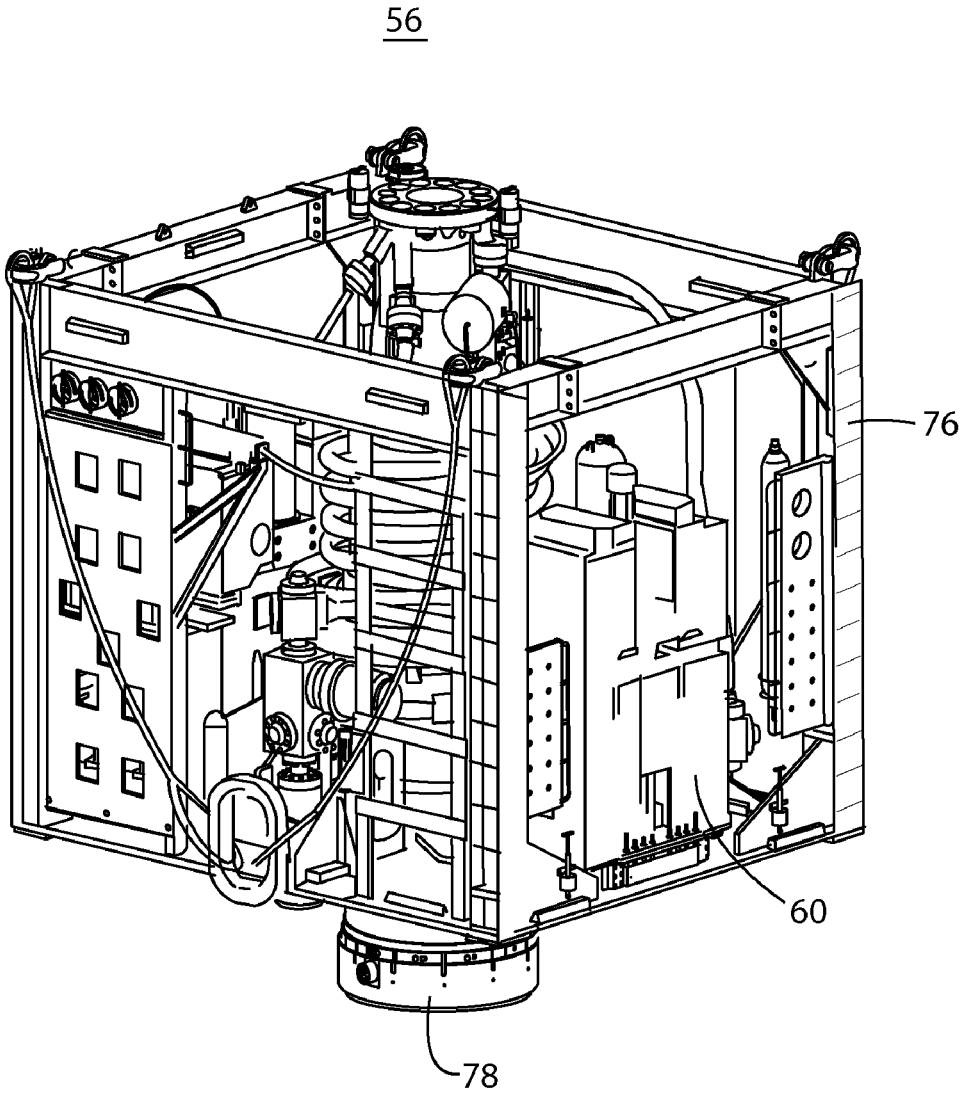
FIG. 5 is a schematic diagram of a lower marine riser package.

An exemplary LMRP 56 is shown in FIG. 5. Part of the elements located on the LMRP are actuated based on hydraulic signals (a fluid under pressure either pumped from the sea level or from accumulators attached to the LMRP) and/or electrical signals. Thus, any subsea structure may have a hydraulic supply and an electric supply. The LMRP 56 may include the MUX pod 60 that is fixed to a frame 76 of the LMRP 56. For redundancy, the LMRP 56 may include two MUX pods 60, one corresponding to the so called yellow circuit and the other one corresponding to the blue circuit. The LMRP 56 may include a connecting mechanism 78 that is configured to connect to the lower BOP stack 58.

Figure 6:
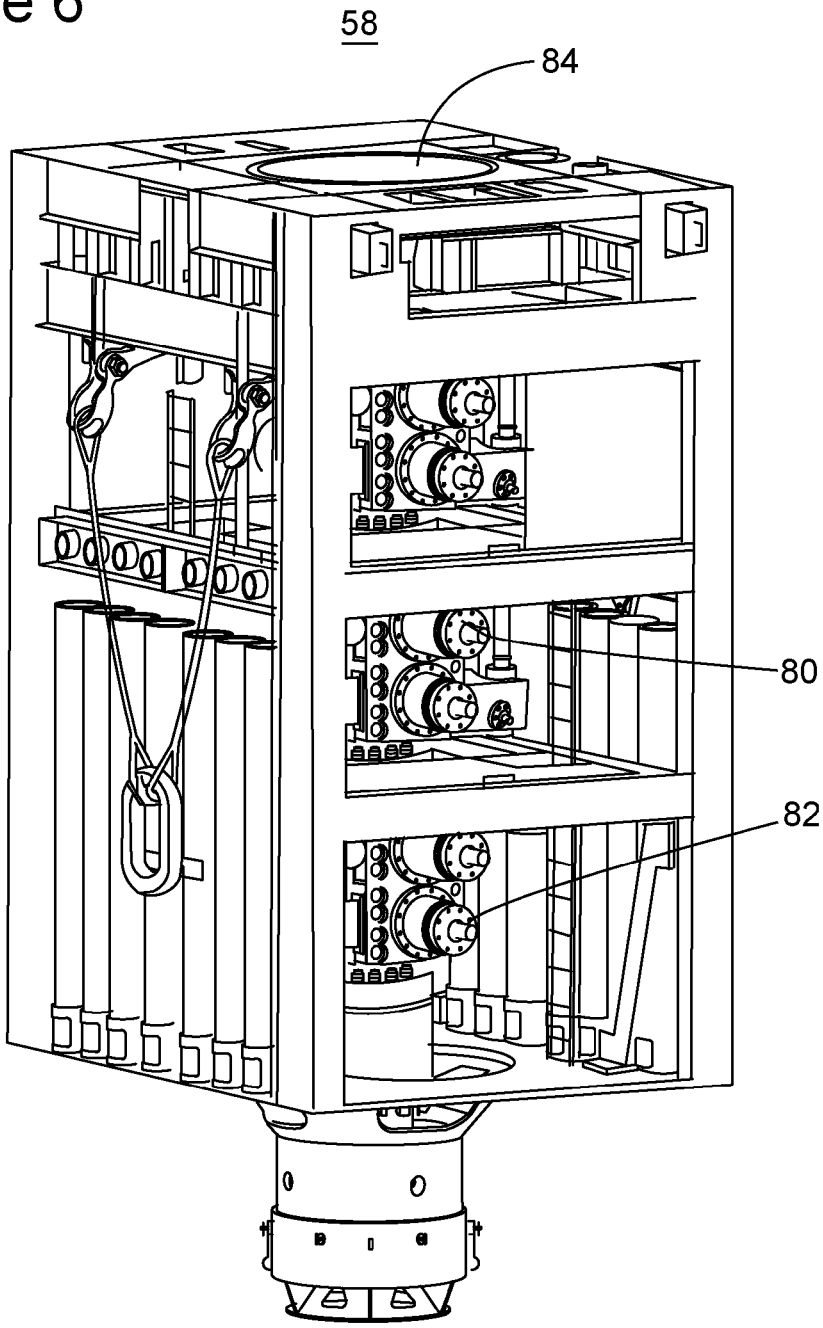
FIG. 6 is a schematic diagram of a blowout preventer stack.

The lower BOP stack 58 is illustrated in FIG. 6 as having plural ram BOPs 80 and 82. It is assumed in this exemplary embodiment that the lower BOP stack 58 has a shearing ram BOP 80 and a blind ram BOP 82, among other ram BOPs. The lower BOP stack 58 also has a receptacle 84 configured to receive the connecting mechanism 78 of the LMRP 56. The hydraulic and electrical signals are transmitted from the MUX pod 60 to the BOP stack 58 via the pod wedge 72 shown in FIG. 4.

For safety reasons, a deadman circuit is implemented for the BOPs. While some of the ram BOPs installed on the lower BOP stack 58 are not designed to shear a drill string or other tools that may be present inside them, the shearing BOP 80 is designed to shear a tool inside it. Thus, when the deadman is tested (as noted above, every 14 days), the drill string has to be removed to a position above the shearing ram BOP or severed by the shearing BOP. Severing is undesired as this process will stop the well exploration, and raising the drill string to prevent shearing is a time consuming way to prove a function test.

Figure 7:
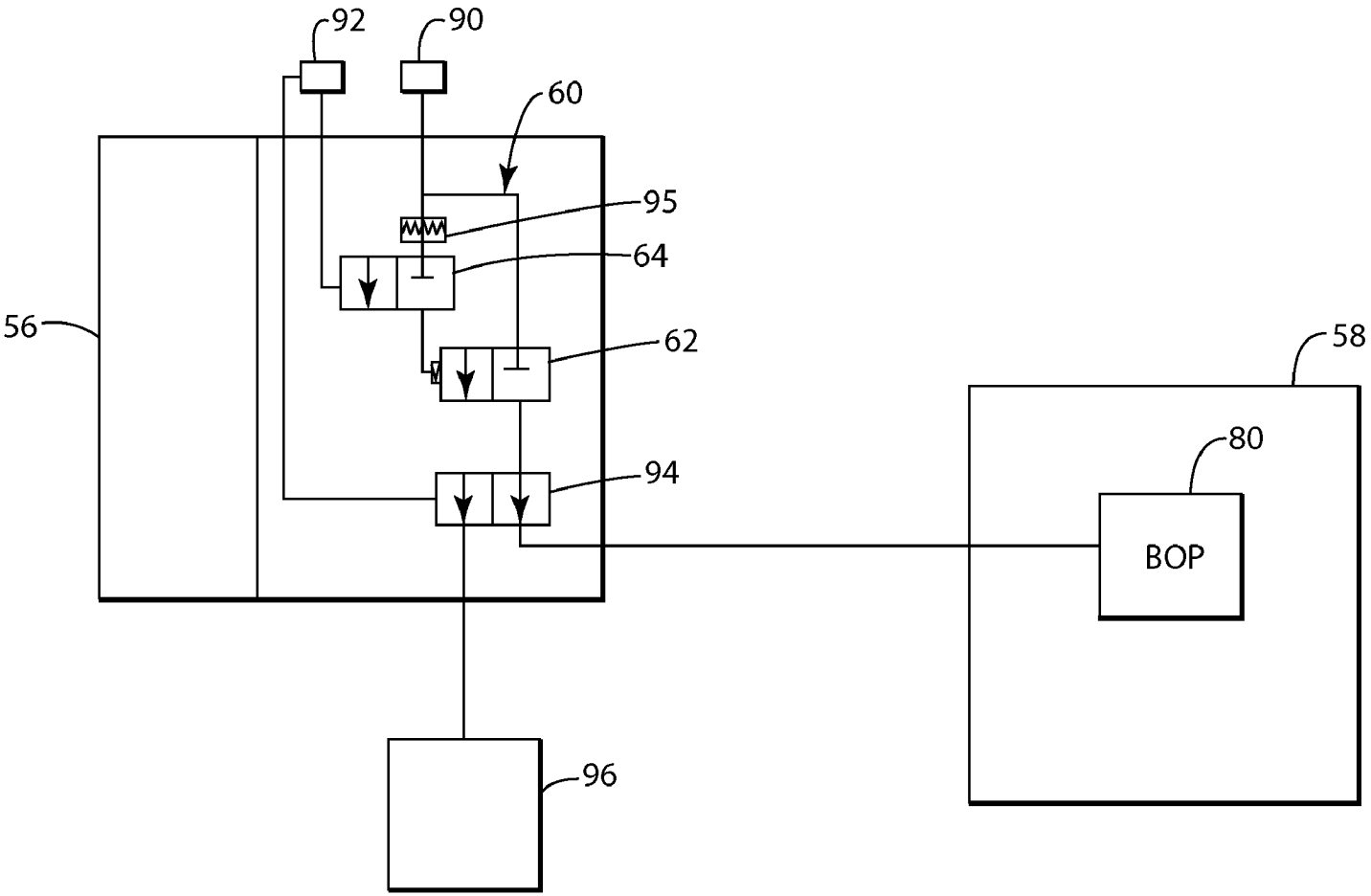
FIG. 7 is a schematic diagram of a deadman circuit according to an exemplary embodiment.

A schematic of a novel deadman circuit is illustrated in FIG. 7. FIG. 7 shows that a hydraulic signal is received at a hydraulic port 90 on the LMRP 56 and an electric signal is received an electric port 92. One or more of these ports may be available on the LMRP 56, e.g., a blue port and a yellow port for redundancy.

The electrical signal is configured to control the closing or opening of the solenoid valve 64. By opening the solenoid valve 64, the hydraulic signal from the hydraulic port 90 is allowed to propagate to the SPM valve 62. When the SPM valve 62 is opened, the hydraulic signals propagate to a selector valve 94, which is not found in the existing deadman circuits. The selector valve 94 may be configured to be, e.g., electrically operated by the operator of the rig via the electrical port 92. However, the selector valve 94 may also be controlled by a hydraulic signal from the hydraulic port 90. Alternatively, the selector valve 94 may be configured to be operated by a remote operated vehicle. In this embodiment, even if the electrical and/or hydraulic functionalities of the vessel or rig fail, the operator can still control the selector valve 94.

The selector valve 94 is configured to communicate with the shearing BOP 80 of the lower BOP stack 58. However, the selector valve 94 may also be configured to communicate with a device 96, to be discussed later. In one application, the default position of the selector valve 94 is to connect the SPM valve 62 to the shearing BOP 80. When the operator of the rig intends to test the shearing BOP 80, the operator may instruct the selector valve 94 to directly connect the SPM valve 62 to the device 96 and to prevent the hydraulic signal to reach the shearing BOP 80 for preventing the shearing of the drill string.

In this way, the deadman test may be performed as often as necessary without disrupting the exploration of the well, without severing the drill string or without having to remove the drill string from the shearing device. After the test is complete, the selection valve 94 is returned to its default position.

FIG. 7 also shows a pressure regulator 95 provided between the hydraulic port 90 and the solenoid valve 64 for changing a pressure of the fluid under pressure. For example, the same fluid under pressure may be used to be supplied to both the solenoid valve 64 and the SPM valve 62. By having the pressure regulator 95, the pressure of the fluid may be reduced for the solenoid valve 64 and left unchanged for the SPM valve 62. The reverse is also possible or it is possible to place a pressure regulator to change a pressure provided to the SPM valve 62.

Figure 8:
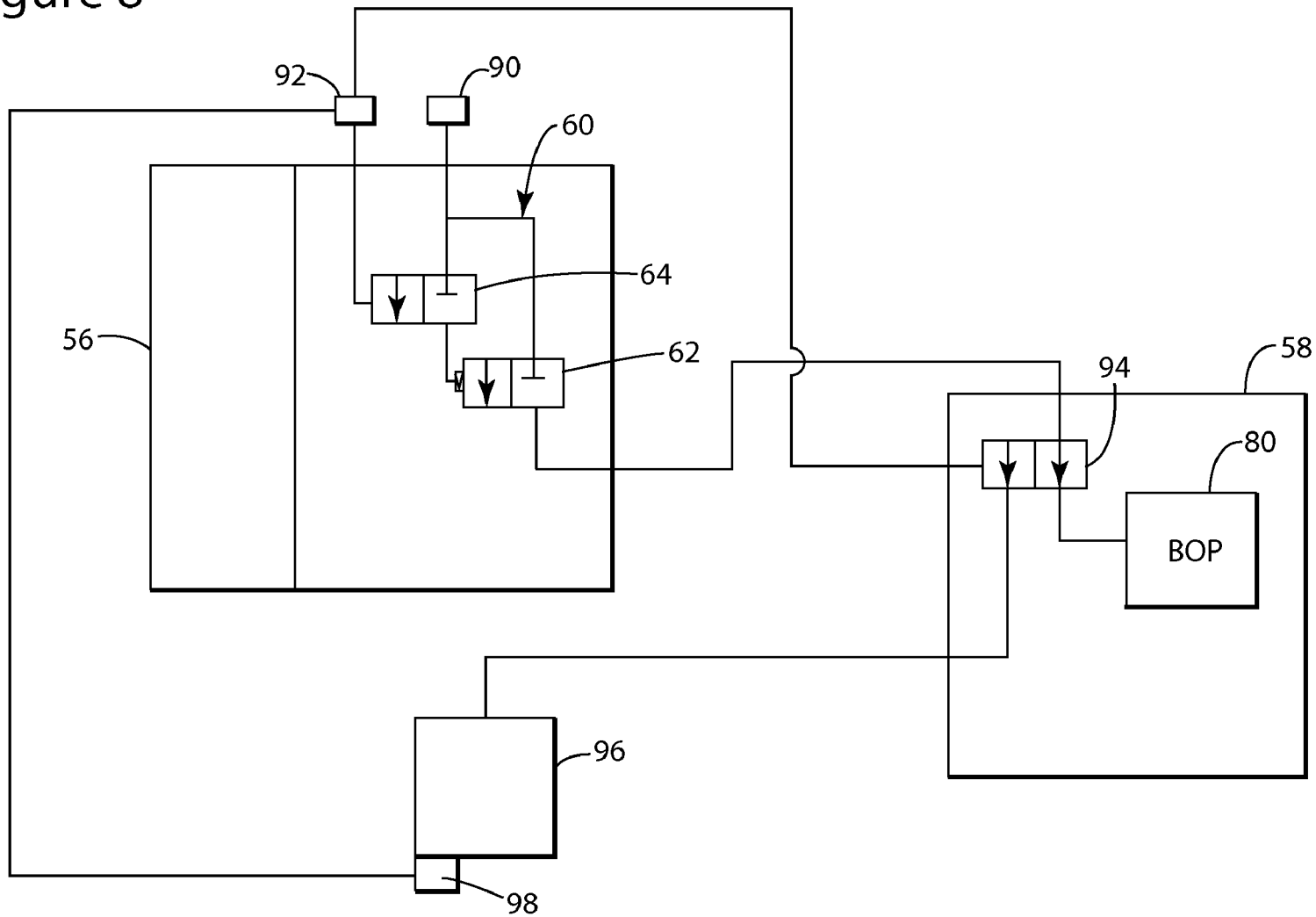
FIG. 8 is a schematic diagram of another deadman circuit according to an exemplary embodiment.

In an exemplary embodiment illustrated in FIG. 8, the location of the selector valve 94 is selected on the lower BOP stack 58. Thus, the location of the selector valve 94 may vary from rig to rig depending on various requirements. Further, the location of the selector valve 94 relative to other valves on the MUX pod or other devices may vary depending from case to case. In one application, the selector valve 94 may be configured to be actuated by a remote actuated vehicle from outside the valve.

According to an exemplary embodiment, the device 96 may be a non-shearing BOP. For example, the device 96 may be the BOP 82, which is a non-shearing BOP. The choice to have the device 96 be a non-shearing BOP is for preventing the shearing of the tools and/or drill string present in the BOP. However, the device 96 may be an apparatus that is not a BOP. For example, the device 96 may be a sensor that is configured to determine the pressure exerted by the fluid under pressure coming from the selector valve 94. Thus, the device 96 may be equipped with a communication port 98 that is configured to communicate the measured pressure, via the electrical port 92, to the operator.

In another exemplary embodiment, the device 96 may be a bottle or accumulator having a pressure sensor. The fluid under pressure from the selector valve 94 is then received by the accumulator and a pressure generated by this fluid under pressure measured. Optionally, the measured pressure may be transmitted to the operator. Still in another exemplary embodiment, the device 96 may have a piston configured to slide inside a cylinder. The cylinder may be configured to receive the fluid under pressure and the piston may be connected to a rod that exits the device 96. After the fluid under pressure is received by the cylinder, the piston moves to a corresponding pressure and the rod is also moved outside the device to a certain position. This position may be read by a remove operated vehicle (ROV) and transmitted to the operator in case that the electric and hydraulic ports 90 and 92 have failed. Many other configurations for the device 96 may be imagined for determining the presence and pressure of the fluid under pressure received by the selector valve 94 and these configurations are intended to be covered by the claims of this application.

Figure 9:
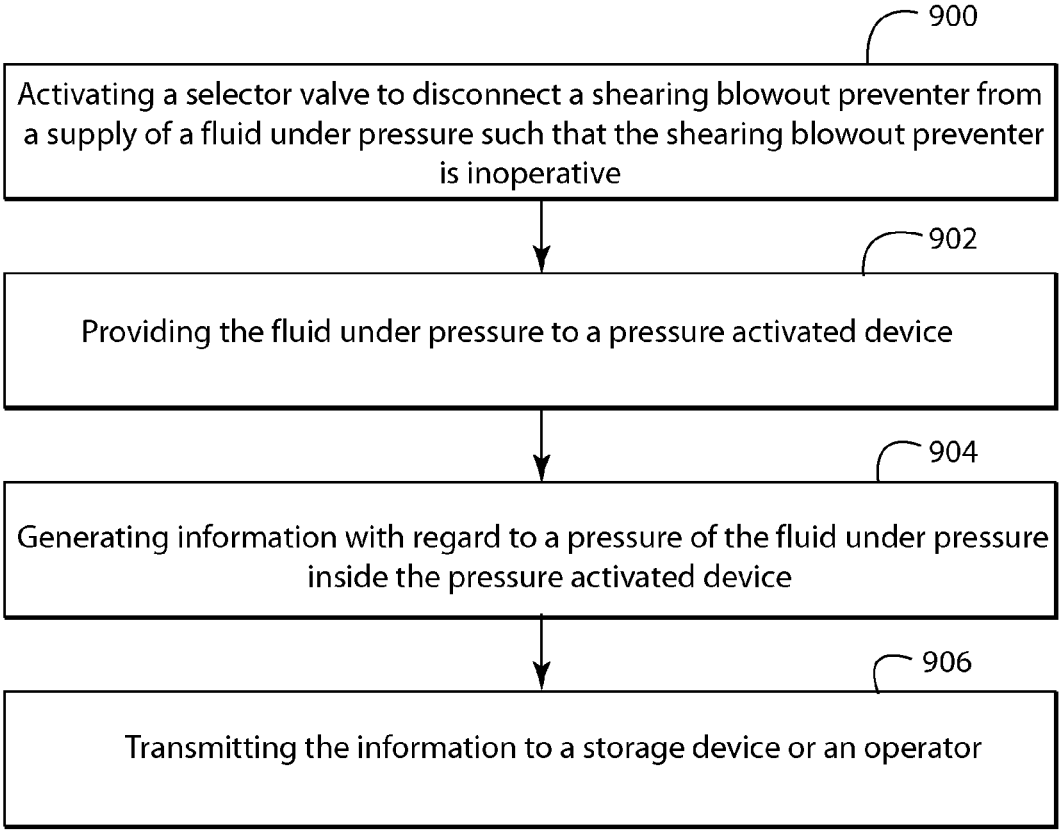
FIG. 9 is a flow chart illustrating a method for performing a deadman test on a shearing blowout preventer.

A method for performing such a deadman test is discussed now with regard to FIG. 9. The method may include a step 900 of activating a selector valve to disconnect a shearing blowout preventer from a supply of a fluid under pressure such that the shearing blowout preventer is inoperative; a step 902 of providing the fluid under pressure to a pressure activated device; a step 904 of generating information with regard to a pressure of the fluid under pressure inside the pressure activated device; and a step 906 of transmitting the information to a storage device or an operator.

Optionally, the method may include a step of configuring the selector valve to default to communicating with the shearing blowout preventer, a step of activating the selector valve to connect the shearing blowout preventer to the supply of fluid under pressure; and a step of instructing the shearing blowout preventer to cut a tool present inside the shearing blowout preventer.

The disclosed exemplary embodiments provide a system and a method for performing a deadman test on a shearing BOP without shearing any tool or drill string present in the shearing BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A deadman test circuit for testing a functionality of a shearing blowout preventer, the deadman test circuit comprising: a solenoid valve configured to be electrically controlled and to receive a fluid under a first pressure; a sub plate mounted valve configured to be hydraulically controlled by the solenoid valve and to receive the fluid under a second pressure; and a selector valve fluidly connecting an output of the sub plate mounted valve to a shearing ram blowout preventer (BOP) and to a device, wherein the selector valve is configured to be operated by an operator.

2. The deadman test circuit of claim 1, wherein the selector valve is electrically controlled by the operator or is controlled by a remote operated vehicle.

3. The deadman test circuit of claim 1, wherein the selector valve is configured to be opened by default for the shearing ram BOP.

4. The deadman test circuit of claim 1, further comprising: a MUX pod configured to host the solenoid valve, the sub plate mounted valve and the selector valve.

5. The deadman test circuit of claim 1, wherein the selector valve is provided on a lower marine riser package that is configured to be provided at an end of a riser.

6. The deadman test circuit of claim 1, wherein the selector valve is provided on a blowout preventer stack that is configured to be provided on a wellhead.

7. The deadman test circuit of claim 1, further comprising: the device, wherein the device is one of a non-shearing blowout preventer, an accumulator, a cylinder having a rod configured to exit the cylinder and to indicate a pressure inside the cylinder, or a pressure sensor.

8. A blowout preventer assembly for sealing a well head, the assembly comprising: a lower marine riser package configured to be provided at an end of a riser and to be lowered undersea; a MUX pod attached to the lower marine riser package and configured to receive a fluid under a first pressure, the MUX pod including, a solenoid valve configured to be electrically controlled and to receive a fluid under a second pressure, and a sub plate mounted valve configured to be hydraulically controlled by the solenoid valve and to receive the fluid under the first pressure; and a selector valve fluidly connecting an output of the sub plate mounted valve to a shearing ram blowout preventer (BOP) and to a device, wherein the selector valve is configured to be operated by an operator.

9. The assembly of claim 8, further comprising: a lower blowout preventer stack configured to be attached to the lower marine riser package and including at least the shearing ram BOP.

10. The assembly of claim 8, wherein the selector valve is electrically controlled by the operator or is operated by a remote operated vehicle.

11. The assembly of claim 8, wherein the selector valve is configured to be opened by default for the shearing ram BOP.

12. The assembly of claim 8, wherein the selector valve is physically located on the lower marine riser package.

13. The assembly of claim 9, wherein the selector valve is physically located on the lower blowout preventer stack.

14. The assembly of claim 8, further comprising: the device, wherein the device is one of a non-shearing ram blowout preventer, an accumulator, a cylinder having a rod configured to exit the cylinder and to indicate a pressure inside the cylinder, or a pressure sensor.

15. A method for performing a deadman test on a shearing blowout preventer, the method comprising: activating a selector valve to disconnect a shearing blowout preventer from a supply of a fluid under pressure such that the shearing ram blowout preventer is inoperative; providing the fluid under pressure to a pressure activated device; generating information with regard to a pressure of the fluid under pressure inside the pressure activated device; and transmitting the information to a storage device or an operator.

16. The method of claim 15, further comprising: configuring the selector valve to default to communicating with the shearing ram blowout preventer.

17. The method of claim 15, further comprising: activating the selector valve to connect the shearing ram blowout preventer to the supply of fluid under pressure; and instructing the shearing ram blowout preventer to cut a tool present inside the shearing ram blowout preventer.

* * * * *